US011988482B2

(12) United States Patent
Chen et al.

(10) Patent No.: US 11,988,482 B2
(45) Date of Patent: May 21, 2024

(54) PNEUMATIC ARROW GUN FOR STABLY SHOOTING ARROWS, SAFETY DEVICE OF AN ARROW AND ARROW WITH THE SAME

(71) Applicant: BANZA STAMPING INDUSTRY CORP., Suao Township, Yilan County (TW)

(72) Inventors: Li-Wei Chen, Suao Township, Yilan County (TW); Tsang-Yao Lu, Suao Township, Yilan County (TW)

(73) Assignee: BANZA STAMPING INDUSTRY CORP., Suao Township, Yilan County (TW)

( * ) Notice: Subject to any disclaimer, the term of this patent is extended or adjusted under 35 U.S.C. 154(b) by 0 days.

(21) Appl. No.: 18/086,181

(22) Filed: Dec. 21, 2022

(65) Prior Publication Data

US 2024/0118052 A1 Apr. 11, 2024

(30) Foreign Application Priority Data

Oct. 7, 2022 (TW) ..... 111138303

(51) Int. Cl.
*F41B 11/83* (2013.01)
*F41B 11/73* (2013.01)

(52) U.S. Cl.
CPC ..... *F41B 11/83* (2013.01); *F41B 11/73* (2013.01)

(58) Field of Classification Search
CPC .. F41B 7/04; F41B 7/043; F41B 11/73; F41B 11/83; F42B 6/02; F42B 6/04
USPC ..... 124/20.3; 102/504; 43/6
See application file for complete search history.

(56) References Cited

U.S. PATENT DOCUMENTS 2,660,993 A 12/1953 Blakeslee
2,796,691 A * 6/1957 Norris ..... F42B 12/362 42/106
2,839,862 A 6/1958 Hanshaw
4,854,067 A * 8/1989 Tersiev ..... F41B 11/83 43/6
5,690,090 A * 11/1997 Bissonnette ..... F42B 6/02 102/504
9,719,752 B1 * 8/2017 Nibecker, Jr. ..... A01K 81/00
2004/0173197 A1 9/2004 Moffitt
(Continued)

OTHER PUBLICATIONS

Search Report of TW Patent Application No. 11138303.

*Primary Examiner* — Bret Hayes
(74) *Attorney, Agent, or Firm* — MUNCY, GEISSLER, OLDS & LOWE, P.C.

(57) ABSTRACT

A pneumatic arrow gun has a gun body, an arrow, a positioning sleeve, and a connecting wire. The arrow is for inserting into an air tube of the gun body. The positioning sleeve is temporarily mounted around the air tube, and the arrow is disposed through the positioning sleeve. The connecting wire connects the gun body to the positioning sleeve. Because the positioning sleeve is temporarily mounted around the air tube, the arrow slides forward relative to the positioning sleeve after triggering. When triggering the arrow, the connecting wire naturally dangles. When the arrow detaches from the air tube, the positioning sleeve located at a nock of the arrow due to the sliding of the arrow. Therefore, a rebound of the arrowhead is prevented. The safety and the shooting stability are ensured. Further, the arrow is easily retrieved by the connecting wire.

14 Claims, 8 Drawing Sheets

(56) References Cited

U.S. PATENT DOCUMENTS

| | | | | |
|---|---|---|---|---|
| 2007/0074711 | A1* | 4/2007 | Gill | F41B 11/83 124/20.3 |
| 2009/0038600 | A1 | 2/2009 | Robinik | |
| 2017/0234660 | A1* | 8/2017 | Carlston | F42B 6/02 124/56 |

* cited by examiner

PNEUMATIC ARROW GUN FOR STABLY SHOOTING ARROWS, SAFETY DEVICE OF AN ARROW AND ARROW WITH THE SAME

CROSS-REFERENCE TO RELATED APPLICATIONS

This application is based upon and claims priority under 35 U.S.C. 119 from Taiwan Patent Application No. 111138303 filed on Oct. 7, 2022, which is hereby specifically incorporated herein by this reference thereto.

BACKGROUND OF THE INVENTION

1. Field of the Invention

The present invention is related to a pneumatic arrow gun, especially to a pneumatic arrow gun for stably shooting arrows.

2. Description of the Prior Arts

Bows and arrows are a tool commonly used in hunting. A hunter usually uses a bow and a plurality of arrows to hunt. After the hunter uses the bow to shoot the arrow, the arrow is usually a certain distance away from the hunter whether the arrow hits a target or not. The hunter often spends a lot of time looking for the arrows or an arrowed target. It is usually to lose several arrows.

Therefore, a conventional bow assembly in accordance with the prior arts is shown in FIG. 6, the conventional bow assembly includes a bow 50, a reel 60, an arrow 70, a safety slide 80, and a connecting wire 90. The reel 60 is fixed to a middle and lower segment of a body 51 of the bow 50. The connecting wire 90 is accommodated in the reel 60 with one end being fixed to the reel 60. Another end of the connecting wire 90 is connected to the safety slide 80. The safety slide 80 is slidably disposed on a shaft 71 of the arrow 70 and is stopped by an arrowhead 72 and a nock 73 of the arrow 70 to keep from departing from the arrow 70.

With reference to FIGS. 6 and 7, when using the conventional bow assembly described above, the nock 73 is pressed against the string 52, and the string 52 is fully drawn backward. During this period, the safety slide 80 relatively slides forward and approaches the arrowhead 72 because the safety slide 80 abuts against the body 51.

With reference to FIGS. 7 and 8, when releasing the string 52 and the nock 73 shown in FIG. 7, a resilience of the string 52 shoots the arrow 70 forward. The safety slide 80 and the end of the connecting wire 90 fixed to the safety slide 80 are shot out with the arrow because the safety slide 80 is stopped by the nock 73. Afterward, as long as pulling the connecting wire 90 back, the arrow 70 is retrieved smoothly.

The conventional bow assembly described above reduces the loss of the arrows 70. However, in the instant, the bow 50 shoots the arrow 70, the safety slide 80 on the arrow 70 and the connecting wire 90 connected to the safety slide 80 increase the weight of the arrow 70. A shooting trajectory is not stabilized, and the rate to hit the target is reduced. Therefore, the tool used in hunting in accordance with the prior arts needs to be improved.

SUMMARY OF THE INVENTION

An objective of the present invention is to provide a pneumatic arrow gun for stably shooting arrows, a safety device of an arrow, and an arrow with the same.

To achieve the objection as mentioned above, the pneumatic arrow gun for stably shooting arrows includes:

- an air gun including a gun body and an air tube connected to the gun body;
- an arrow disposed in the air tube of the air gun and including a nock, a shaft, and an arrowhead from back to front, wherein the arrowhead is located outside the air tube;
- a positioning sleeve including:
  - a sleeve body matching and mounted around an outside wall of an air tube muzzle of the air tube; and
  - a stop ring integrally formed on an inside wall of a front part of the sleeve body, abutting against the air tube muzzle of the air tube, and used for the shaft of the arrow to be slidably disposed therein, wherein a maximum width of the nock of the arrow is larger than an inner diameter of the stop ring; and
- a connecting wire having:
  - a first end fixed to the gun body of the air gun; and
  - a second end fixed to the positioning sleeve.

The advantage of the present invention is that through the sleeve body of the positioning sleeve, the positioning sleeve is temporarily mounted around the air tube muzzle of the air gun. Through the stop ring integrally formed on the sleeve body, the arrow slides forward relative to the positioning sleeve when the arrow in the air tube is triggered by the air gun. After the arrow is triggered but has not yet detached from the air tube, the connecting wire fixed to the positioning sleeve naturally dangles and does not wrap around the air gun or the arrow. At the same time, the stop ring guides the arrow and the arrow head of the arrow to detach from the gun body on a correct trajectory. When the arrow detaches from the air tube, the nock contacts the stop ring, and the positioning sleeve is relatively located at the nock of the arrow. Thus, due to the connecting wire naturally dangling and does not wrap around the air gun or the arrow, a tensile force does not affect the arrow. A Rebound of the arrowhead is kept from the tensile force or wrapping of the connecting wire 40 and does not cause injury to a user. A safety and a shooting stability are ensured. Simultaneously, after the arrow detaches from the air tube, the positioning sleeve and the second end of the connecting wire also detach from the air tube with the arrow. Subsequently, the arrow and the positioning sleeve are also retrieved through the connecting wire on the gun body.

To achieve the objection as mentioned above, the safety device of an arrow includes:

- a positioning sleeve including:
  - a sleeve body for mounting around an outside wall of an air tube muzzle of an air tube; and
  - a stop ring integrally formed on an inside wall of the sleeve body used for an arrow to be slidably disposed therein; and
- a nock sleeve used for being mounted around a back end of a shaft of an arrow, wherein an outer diameter of the nock sleeve is larger than an inner diameter of the stop ring of the positioning sleeve.

The advantage of the present invention is that temporarily mounted the positioning sleeve around the air tube muzzle of the air tube of an air gun and the stop ring integrally formed on the inside wall of the sleeve body. When the arrow disposed in the air tube is triggered by the air gun, but the arrow has not completely detached from the air tube, the stop ring guides a shooting trajectory of the arrow. After the arrow detaches from the air tube, a rebound of the arrowhead is prevented and does not cause injury to a user. An safety and a shooting stability of the arrow are ensured.

To achieve the objection as mentioned above, the arrow includes:

a positioning sleeve including:

a sleeve body; and a stop ring integrally formed on an inside wall of the sleeve body; and a shaft slidably disposed in the stop ring of the positioning sleeve and having:

an arrowhead disposed on a front end of the shaft;

a nock disposed on a back end of the shaft, wherein a maximum diameter of the nock is larger than a inner diameter of the stop ring of the positioning sleeve.

The advantage of the present is that the stop ring integrally formed in the sleeve body for the shaft slidably disposed in. When the arrow is triggered but has not completely detached from the air tube, the stop ring guides a shooting trajectory of the arrow. A rebound of the arrowhead is prevented and does not cause injury to a user after detaching from a triggering device. An safety and a shooting stability of the arrow are ensured. After the arrow detaches from the triggering device, the nock contacts the stop ring, and the positioning sleeve detaches from the triggering device with the arrow. Subsequently, when the arrow is retrieved, the positioning sleeve is also retrieved.

DETAILED DESCRIPTION OF THE EMBODIMENTS

With an embodiment and drawings thereof, the features of the present invention are described in detail as follows.

Figure 1:
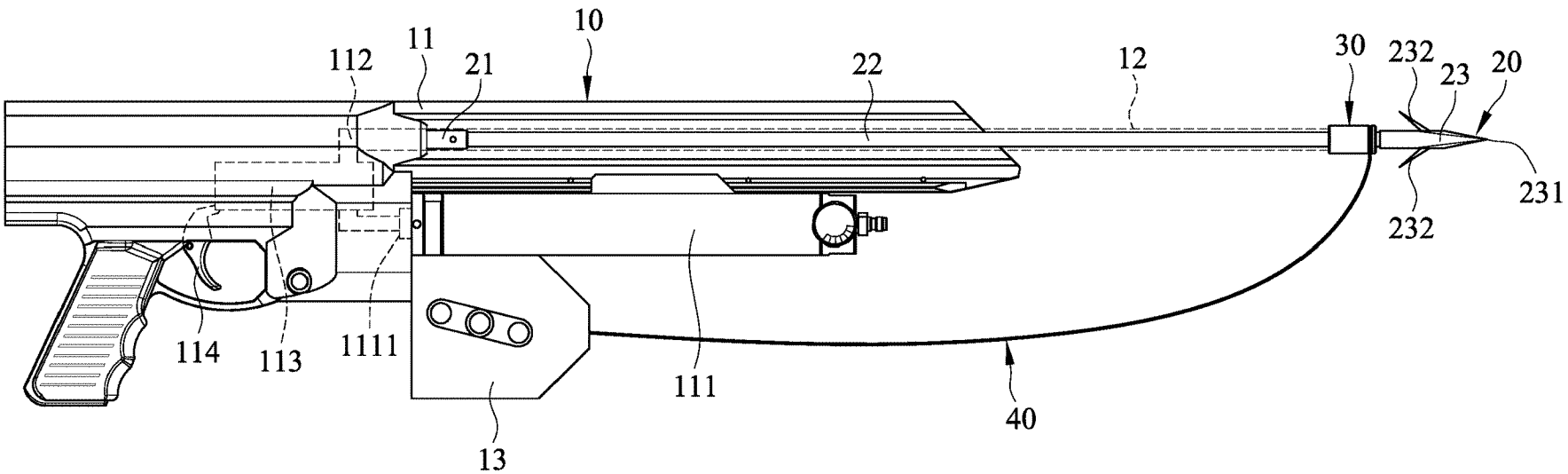
FIG. 1 is a side view of a pneumatic arrow gun for stably shooting arrows in accordance with the present invention.

With reference to FIG. 1, a pneumatic arrow gun for stably shooting arrows in accordance with the present invention comprises an air gun 10, an arrow 20, a positioning sleeve 30, and a connecting wire 40.

The air gun 10 comprises a gun body 11 and an air tube 12, and may further comprise a reel 13. The air tube 12 is connected to the gun body 11, and the reel 13 is mounted on the gun body 11. In the present embodiment, the gun body 11 comprises an air bottle 111, a connecting pipe 112, a switch unit 113, and a trigger 114. The air bottle 111 is mounted on the gun body 11, has an air outlet 1111 disposed into the gun body 11, and stores a high-pressure gas therein. The connecting pipe 112 is disposed in the gun body 11 and connects between the air outlet 1111 of the air bottle 111 and the air tube 12. The switch unit 113 is mounted inside the gun body 11 and is connected to the connecting pipe 112. The trigger 114 is connected to the switch unit 113 and exposed from the gun body 11. A user pulls the trigger 114 to turn on the switch unit 113 so that the air bottle 111 selectively communicates with the air tube 12. Thus, the high-pressure gas stored in the air bottle 111 is used as a source of a thrust force for the air gun 10.

Figure 3:
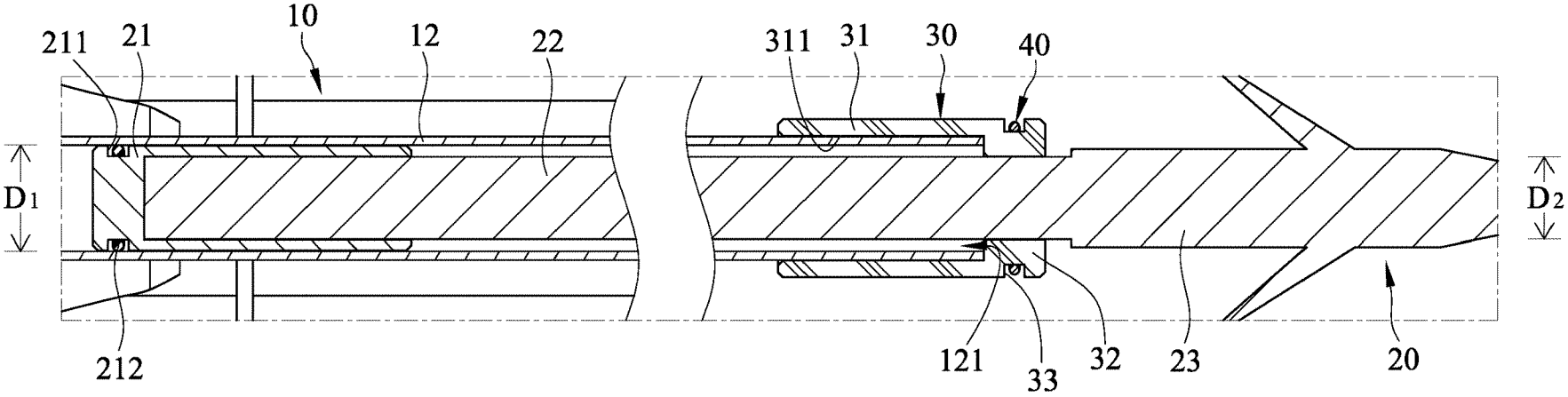
FIG. 3 is an enlarged view of a part of the pneumatic arrow gun in FIG. 1.

The arrow 20 is disposed in the air tube 12 of the air gun 10. When the trigger 114 of the gun body 11 is pulled, the arrow 20 is pushed forward by the high-pressure gas to detach from the air tube 12. The arrow comprises a nock, a shaft 22, and an arrowhead 23 from back to front. As shown in FIG. 3, in one embodiment, the nock is consisted of a nock sleeve 21 to mount around a back end of the shaft 22. The nock sleeve 21 is disposed in the air tube 12 of the air gun 10. In the present embodiment, the nock sleeve 21 has an outer diameter D1 matching an inner diameter of the air tube 12, so that the nock sleeve 21 may be coaxially disposed in the air tube 12. The nock sleeve 21 comprises an annular groove 211 and an air-tight ring 212, the annular groove 211 is formed on an outside wall of the nock sleeve 21. In one embodiment, the annular groove 211 is formed near a rear end of the nock sleeve 21. The air-tight ring 212 may be made of a rubber, may be an O-ring, is mounted around the annular groove 211, and air-tightly contacts an inside wall of the air tube 12. When the user holds the air gun 10 and an air tube muzzle 121 of the air tube 12 faces downward, the air-tight ring 212 keeps the arrow 20 from slipping out of the air tube 12 by gravity. The air-tight ring 212 also keeps the high-pressure gas from leaking through a gap between the nock sleeve 21 and the air tube 12 when the arrow 20 is triggered so that the shooting power is retained. the shaft 22 may be a solid rod, but is not limited thereto. Most of the shaft 22 is disposed in the air tube 12 with the nock sleeve 21, and a small part of the shaft 22 at a front end thereof extends out of the air tube muzzle 121 of the air tube 12. In one embodiment, the arrowhead 23 is mounted around the front end of the shaft 22, is located outside the air tube 12, and comprises an arrow tip 231 and at least one barb 232. The arrow tip 231 is formed on a front end of the arrowhead 23. The at least one barb 232 is disposed on the arrowhead 23. An angle is defined between the arrowhead 23 and the at least one barb 232. After the arrowhead hits a target, the at least one barb 232 assists to fix the arrowhead 23 in the target.

Figure 2:
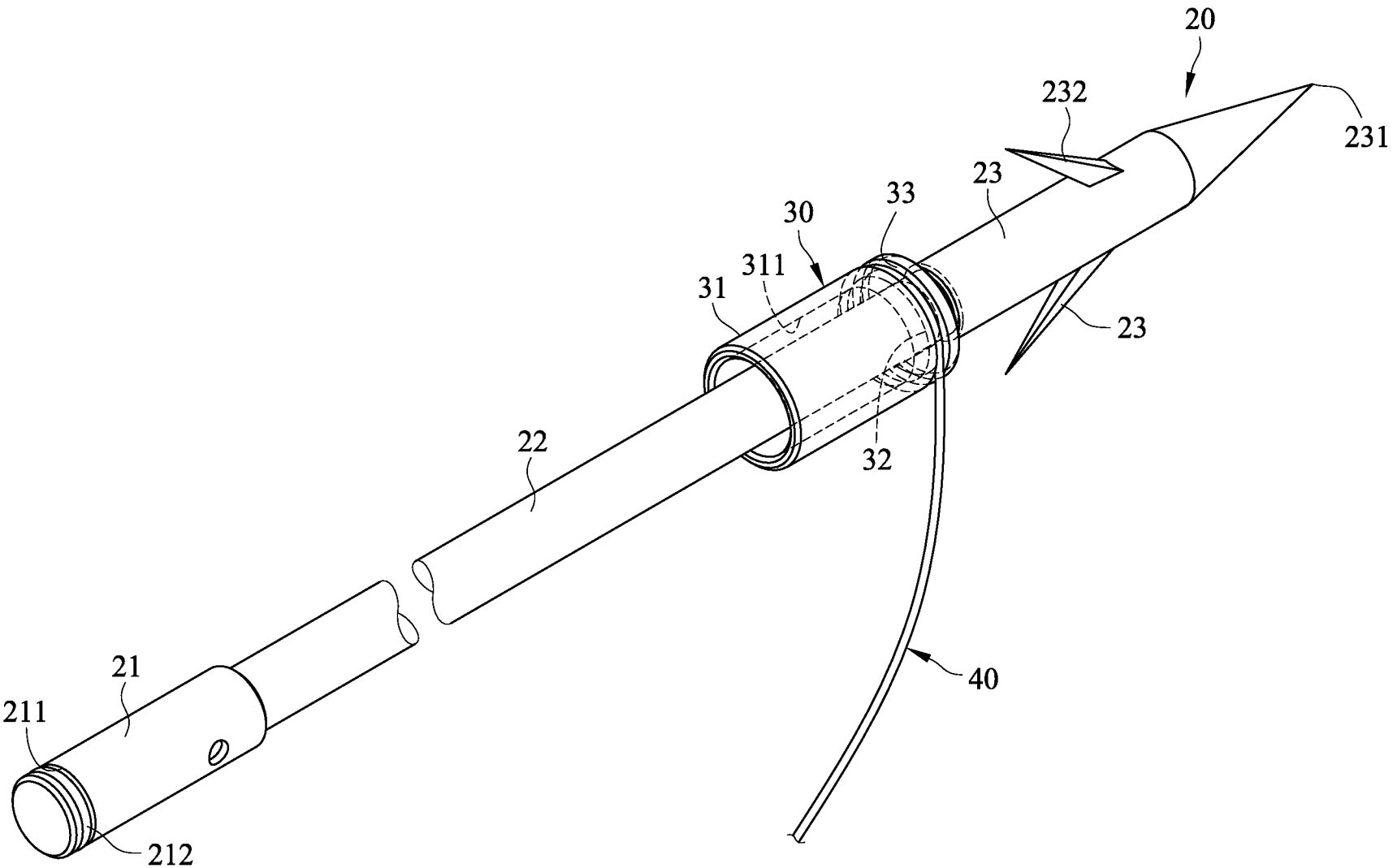
FIG. 2 is a perspective view of an arrow and a positioning sleeve in accordance with the present invention.

As shown in FIGS. 2 and 3, the positioning sleeve 30 is a safety device of an arrow in accordance with the present invention. The positioning sleeve 30 comprises a sleeve body 31 and a stop ring 32, and may further comprise a ring groove 33. The sleeve body 31 matches and is mounted around an outside wall of the air tube muzzle 121 of the air tube 12, that is, an inner diameter of the sleeve body 31 matches an outer diameter of the air tube muzzle 121. The stop ring 32 is integrally formed on an inside wall 311 of a front portion of the sleeve body 31 to abut against the air tube muzzle 121 of the air tube 12 and has an inner diameter corresponds to the outer diameter of the shaft 22. Thus, the shaft 22 of the arrow 20 stably and slidably disposed in the stop ring 32 and the air tube 12. In one embodiment, the positioning sleeve 30 may be coaxially mounted around the outside wall of the air tube muzzle 121 of the air tube 12 and may be coaxial with the nock sleeve 21 of the arrow 20. Therefore, after the arrow 20 is triggered, the arrow 20 does not shake radially and follows a stable trajectory to be triggered. A maximum width of the nock is larger than an inner diameter D2 of the stop ring 32. In one embodiment, the outer diameter D1 of the nock sleeve 21 is larger than the inner diameter D2 of the stop ring 32.

The connecting wire 40 has a first end and a second end. The first end of the connecting wire 40 is fixed to the gun body 11 of the air gun 10, and the second end of the connecting wire 40 is fixed to the positioning sleeve 30. In the present embodiment, the first end of the connecting wire 40 is fixed to the reel 13, and the second end of the connecting wire 40 is fixed to the ring groove 33 of the positioning sleeve 30. A dangling wire between the first end and the second end is accommodated in the reel 13 so that the connecting wire 40 is naturally located at an underside of the air gun 10. Thus, the connecting wire 40 does not wrap around the air gun 10 or the arrow 20, a safety is ensured. After the arrow 20 detaches from the air gun 10, the connecting wire 40 assists the user to retrieve the arrow 20.

A structure of the pneumatic arrow gun for stably shooting arrows in accordance with the present invention is described above, a shooting process is further introduced as follows.

Figure 4:
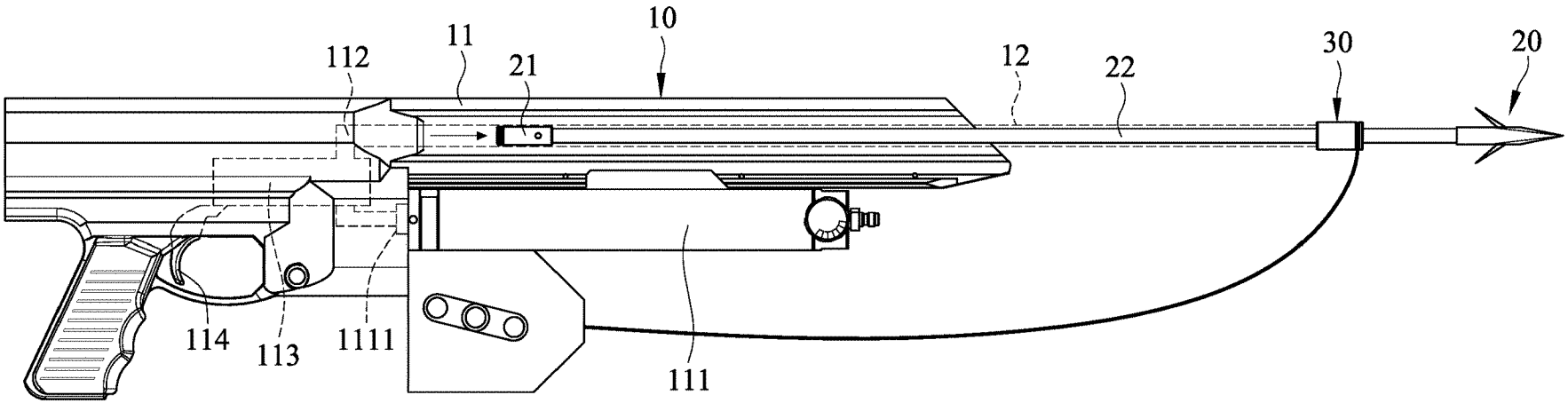
FIG. 4 is an operational side view of the pneumatic arrow gun in FIG. 1 when triggering.

With reference to FIG. 4, when using the pneumatic arrow gun as described, the trigger 114 is pulled to turn on the switch unit 113. Subsequently, the connecting pipe 112 communicates the air outlet 1111 of the air bottle 111 and the air tube 12 of the air gun 10 to charge the high-pressure gas stored in the air bottle into the air tube 12, the nock sleeve 21 of the arrow 20 is pushed by the high-pressure gas, and the arrow 20 is triggered. As shown in FIG. 3, the air-tight ring 212 of the nock sleeve 21 air-tightly seals the gap between the nock sleeve 21 and the air tube 12. Thus, a pressure provided by the high-pressure gas is efficiently converted to a thrust force of the arrow 20 and the shooting power of the arrow 20 is effectively improved. Furthermore, the dangling wire of the connecting wire 40 is accommodated in the reel 13 and is naturally located at the underside of the air gun 10 because the sleeve body 31 of the positioning sleeve 30 is temporarily mounted around the air tube muzzle 121 of the air tube 12. Therefore, the connecting wire 40 does not affect the shooting trajectory of the arrow 20, and the safety when used is improved. Moreover, the stop ring 32 of the positioning sleeve 30 guides the shaft 22 of the arrow 20 to follow a stable trajectory because the shaft 22 of the arrow 20 is slidably disposed in the stop ring 32. Thus, the arrow does not shake in the air tube 12 when shooting, the shooting stability is also improved.

Figure 5:
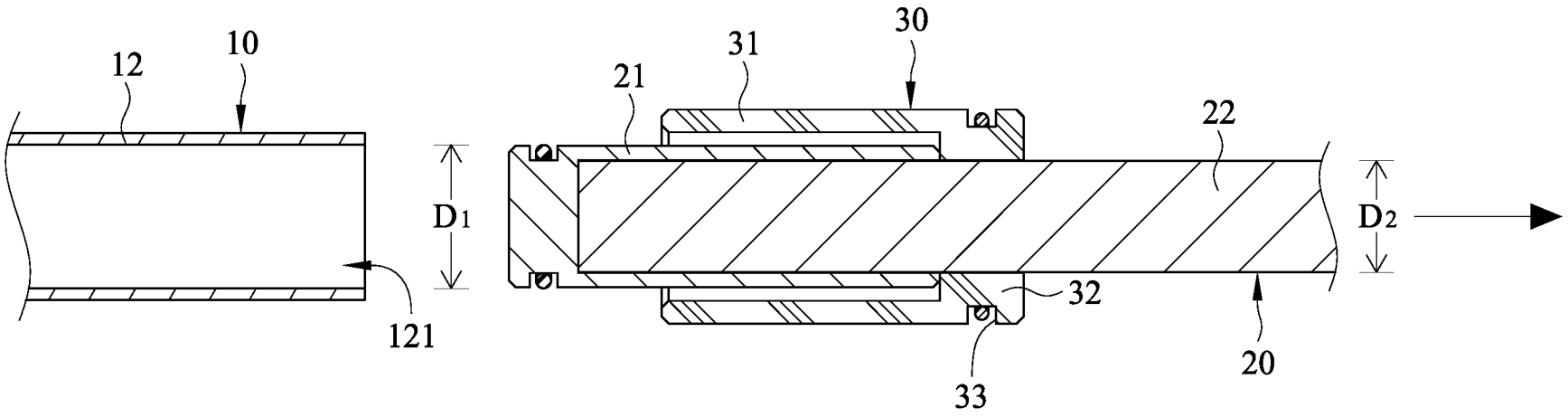
FIG. 5 is an enlarged side view in a partial section of the pneumatic arrow gun in accordance with the present invention after the moment of triggering, and the arrow detaches from an air tube.
Figure 6:
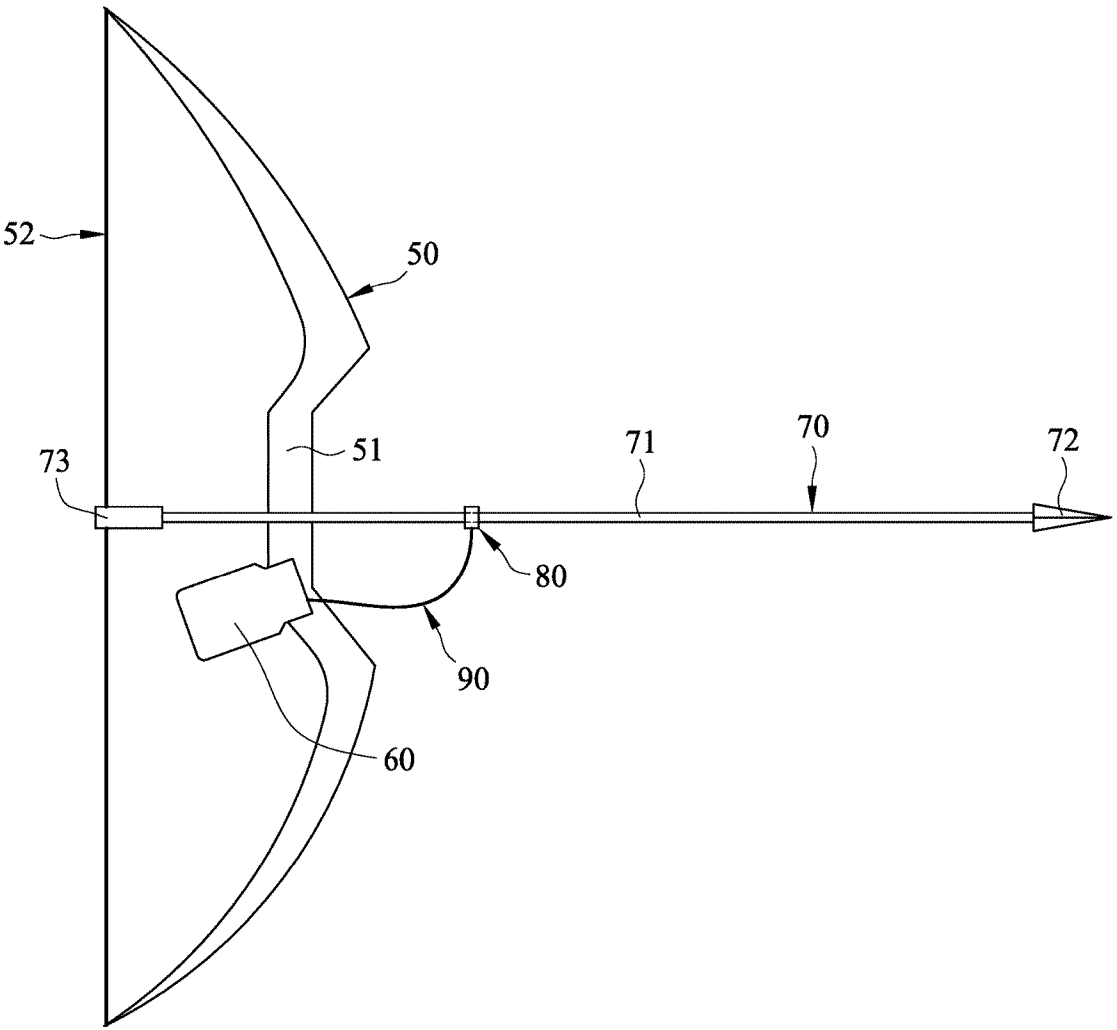
FIG. 6 (PRIOR ART)
FIG. 6 is a side view of a conventional manual bow assembly in accordance with the prior arts.
Figure 7:
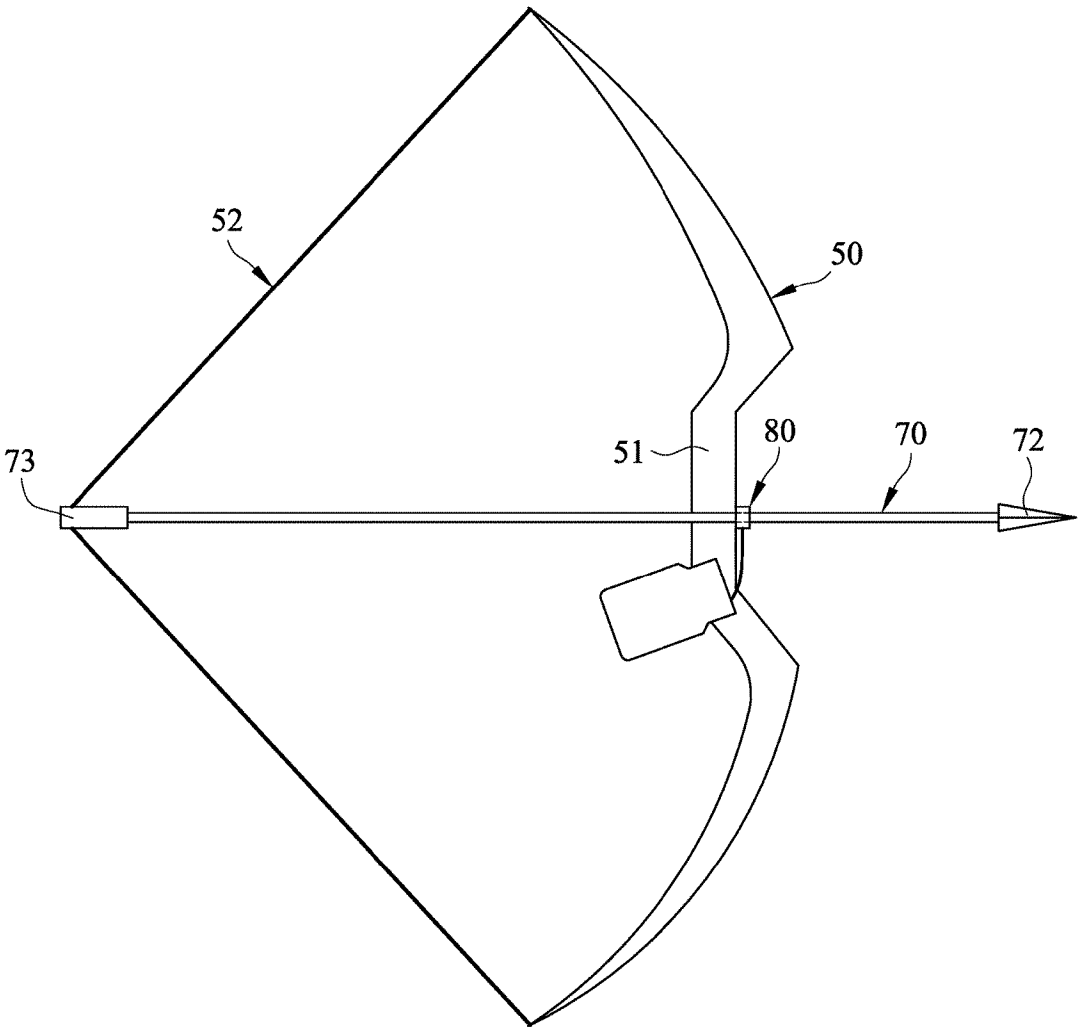
FIG. 7 (PRIOR ART)
FIGS. 7 and 8 are schematic views illustrating the use of the conventional manual bow assembly in FIG. 6.
Figure 8:
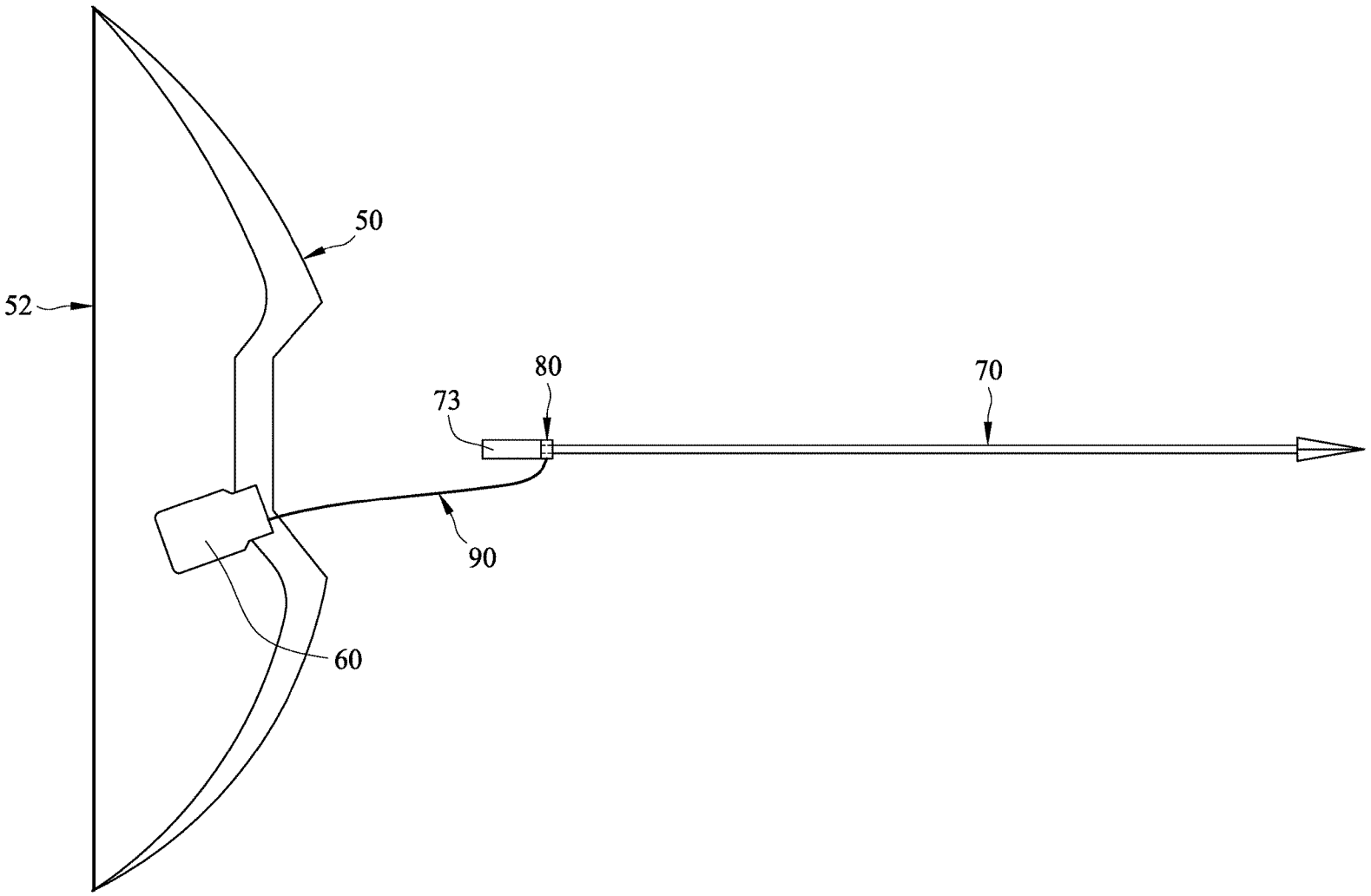
FIG. 8 (PRIOR ART)

After the arrow 20 is triggered by the air gun 10, the nock sleeve 21 of the arrow 20 slides forward and near the air tube muzzle 121 of the air tube 12, but has not detached from the air tube 12, and contacts the stop ring 32. With further reference to FIG. 5, after the arrow 20 detaches from the air tube 12, the positioning sleeve 30 and the second end of the connecting wire 40 fixed to the ring groove 33 detach from the air tube 12 with the nock sleeve 21. A tensile force of the connecting wire 40 does not affect the arrow 20 because the positioning sleeve 30 is located at the nock sleeve 21 of the arrow 20 after the arrow 20 detaches from the air tube 12, and a rebound of the arrowhead 23 is prevented. The arrowhead 23 of the arrow 20 is ensured to follow a correct trajectory to be shot and does not cause injury to the user. Furthermore, as shown in FIGS. 1 and 3, the first end of the connecting wire 40 is fixed to the reel 13 of the air gun 10. Thus, after the arrow 20 is shot or hits the target, the user retrieves the arrow 20 by the connecting wire 40 or further retrieves the target with the arrow 20 by the connecting wire 40.

With the foregoing description, through fixing the connecting wire by the positioning sleeve, the connecting wire does not wrap around the air gun or the arrow. The trajectory of the arrow is not affected by the connecting wire. The sleeve body of the positioning sleeve matches and is mounted around the air tube muzzle of the air tube, and the shaft of the arrow is slidably disposed in the stop ring of the positioning sleeve. Thus, when the arrow slides forward and detaches from the air tube, the positioning sleeve is located at the nock sleeve of the arrow. The arrow is not affected by the tensile force of the connecting wire so that a rebound of the arrowhead is prevented and does not cause injury to the user, and the safety when using is ensured. Furthermore, by using the positioning sleeve and the stop ring to stabilize the shooting trajectory of the arrow, an additional guiding structure does not need to be formed in the air tube of the air gun, thus the air tube of the air gun is simplified. Moreover, the maximum width of the nock sleeve of the arrow, that is, the outer diameter of the nock sleeve is larger than the inner diameter of the stop ring of the positioning sleeve. Thus, when the nock sleeve of the arrow detaches from the air tube, the positioning sleeve also detaches from the air tube with the nock sleeve. At the same time, because the first and second ends of the connecting wire are respectively fixed to the reel of the air gun and the ring groove of the positioning sleeve, the user retrieves the arrow and the positioning sleeve through the connecting wire fixed to the reel.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pneumatic arrow gun comprising:

an air gun comprising a gun body and an air tube connected to the gun body;

an arrow disposed in the air tube of the air gun and comprising a nock, a shaft, and an arrowhead from back to front, wherein the arrowhead is located outside the air tube;

a positioning sleeve comprising a sleeve body matching and mounted around an outside wall of an air tube muzzle of the air tube; and a stop ring integrally formed on an inside wall of a front part of the sleeve body, abutting against the air tube muzzle of the air tube, and used for the shaft of the arrow to be slidably disposed therein, wherein a maximum width of the nock of the arrow is larger than an inner diameter of the stop ring; and a connecting wire having a first end fixed to the gun body of the air gun; and a second end fixed to the positioning sleeve.

2. The pneumatic arrow gun as claimed in claim 1, wherein the sleeve body of the positioning sleeve further has a ring groove formed on an outside wall of the sleeve body; and the second end of the connecting wire is fixed to the ring groove.

3. The pneumatic arrow gun as claimed in claim 2, wherein the nock comprises:

an annular groove formed on an outside wall of the nock; and an air-tight ring mounted around the annular groove and air-tightly contacting an inside wall of the air tube.

4. The pneumatic arrow gun as claimed in claim 2, wherein the air gun further comprises a reel; and the first end of the connecting wire is fixed to the reel.

5. The pneumatic arrow gun as claimed in claim 4, wherein the gun body of the air gun comprises:

an air bottle mounted on the gun body and having an air outlet disposed into the gun body;

a connecting pipe disposed in the gun body and connecting between the air outlet of the air bottle and the air tube of the air gun;

a switch unit mounted inside the gun body and connected to the connecting pipe; and a trigger connected to the switch unit and exposed from the gun body for pulling to turn on or turn off the switch unit, wherein when the trigger is pulled, the switch unit is turned on to communicate the air outlet of the air bottle with the air tube of the air gun through the connecting pipe.

6. The pneumatic arrow gun as claimed in claim 3, wherein the nock is consisted of a nock sleeve; and an outer diameter of the nock sleeve defines the maximum width of the nock.

7. The pneumatic arrow gun as claimed in claim 3, wherein the air gun further comprises a reel; and the first end of the connecting wire is fixed to the reel.

8. The pneumatic arrow gun as claimed in claim 7, wherein the gun body of the air gun comprises:

an air bottle mounted on the gun body and having an air outlet disposed into the gun body;

a connecting pipe disposed in the gun body and connecting between the air outlet of the air bottle and the air tube of the air gun;

a switch unit mounted inside the gun body and connected to the connecting pipe; and a trigger connected to the switch unit and exposed from the gun body for pulling to turn on or turn off the switch unit, wherein when the trigger is pulled, the switch unit is turned on to communicate the air outlet of the air bottle with the air tube of the air gun through the connecting pipe.

9. The pneumatic arrow gun as claimed in claim 6, wherein the arrowhead of the arrow is mounted around a front end of the arrow, and comprises:

an arrow tip formed on the front end of the arrowhead; and at least one barb disposed on the arrowhead, and form an angle with the arrowhead.

10. The pneumatic arrow gun as claimed in claim 9, wherein the shaft of the arrow is a solid rod.

11. The pneumatic arrow gun as claimed in claim 9, wherein the air gun further comprises a reel; and the first end of the connecting wire is fixed to the reel.

12. The pneumatic arrow gun as claimed in claim 1, wherein the air gun further comprises a reel; and the first end of the connecting wire is fixed to the reel.

13. The pneumatic arrow gun as claimed in claim 12, wherein the gun body of the air gun comprises:

an air bottle mounted on the gun body and having an air outlet disposed into the gun body;

a connecting pipe disposed in the gun body and connecting between the air outlet of the air bottle and the air tube of the air gun;

a switch unit mounted inside the gun body and connected to the connecting pipe; and a trigger connected to the switch unit and exposed from the gun body for pulling to turn on or turn off the switch unit, wherein when the trigger is pulled, the switch unit is turned on to communicate the air outlet of the air bottle with the air tube of the air gun through the connecting pipe.

14. The pneumatic arrow gun as claimed in claim 13, wherein the gun body of the air gun comprises:

an air bottle mounted on the gun body and having an air outlet disposed into the gun body;

a connecting pipe disposed in the gun body and connecting between the air outlet of the air bottle and the air tube of the air gun;

a switch unit mounted inside the gun body and connected to the connecting pipe; and a trigger connected to the switch unit and exposed from the gun body for pulling to turn on or turn off the switch unit, wherein when the trigger is pulled, the switch unit is turned on to communicate the air outlet of the air bottle with the air tube of the air gun through the connecting pipe.

* * * * *